United States Patent [19]

Ellwanger et al.

[11] 4,144,678

[45] Mar. 20, 1979

[54] METHOD FOR RESHARPENING CUTTING BLADES FOR GEAR CUTTING MACHINERY

[75] Inventors: Charles G. Ellwanger; Harry Pedersen, both of Rochester, N.Y.

[73] Assignee: The Gleason Works, Rochester, N.Y.

[21] Appl. No.: 812,197

[22] Filed: Jul. 5, 1977

[51] Int. Cl.[2] ..... B24B 1/00

[52] U.S. Cl. ..... 51/288

[58] Field of Search ..... 51/125.5, 134, 288, 51/326, 327

[56] References Cited

U.S. PATENT DOCUMENTS

| | | | |
|---|---|---|---|
| 3,156,074 | 11/1964 | Baltz | 51/288 X |
| 3,162,987 | 12/1964 | Cronin | 51/288 |
| 3,487,592 | 1/1970 | Kotthaus | 51/288 |
| 3,561,170 | 2/1971 | Dupuis | 51/288 |
| 3,881,889 | 5/1975 | Hunkeler | 51/288 |

*Primary Examiner*—Gary L. Smith

*Attorney, Agent, or Firm*—Ralph E. Harper

[57] ABSTRACT

An improved method for resharpening cutting blades for gear cutting machines provides for accurate positioning of the cutting blades relative to a single grinding plane of a grinding wheel. The method includes steps of positioning the cutting blades in a certain relationship to a reference axis so that the reference axis can be used for establishing critical geometric relationships for the resharpened surfaces of the cutting blades.

4 Claims, 15 Drawing Figures

METHOD FOR RESHARPENING CUTTING BLADES FOR GEAR CUTTING MACHINERY

BACKGROUND AND SUMMARY OF THE INVENTION

The present invention relates to the type of resharpening method disclosed in U.S. Pat. No. 3,881,889, commonly owned herewith. In addition, the cutting blade product which can be produced by this method is disclosed and described with reference to a specific design of cutter head assembly in copending application Ser. No. 741,837, filed on Nov. 15, 1976 (now issued as U.S. Pat. No. 4,060,881) by A. B. Ryan and C. Thomas under the title "Improved Cutter Head Assembly for Gear Cutting Machines" (also commonly owned with the present application). This specification is directed primarily to a method for resharpening, and a companion application (filed on Sept. 6, 1977, Ser. No. 831,013; by Charles G. Ellwanger and Harry Pedersen, under the title Apparatus for Precision Grinding of Cutting Blades) will be directed to specific apparatus for carrying out this method.

As pointed out in U.S. Pat. No. 3,881,889, dimensional relationships and closeness of tolerances are extremely important in the design and manufacture of cutting tools for gear cutting machinery capable of generating tooth profiles for bevel and hypoid gears. Similar requirements apply to spur and helical gear manufacture. In addition, the geometry of cutting blades for such machinery has been relatively complex in order to accommodate geometric changes which may be desired or required in the finished gear product. As a result of these special requirements for cutting tools of this type, there has been a long history of manufacture and usage of cutting tools which are relatively complex and costly in terms of design and ease of manufacture.

Thus, there has been a need for reducing complexity of such cutting tools and for improving the processes by which they are formed so that cutting blades for gear cutting machinery can be more easily manufactured at a lower cost to the ultimate user of such blades. There have been efforts, in recent years, to satisfy this need with cutting blades having relatively simple geometry of the type shown, for example, in U.S. Pat. No. 3,487,592, but even cutting blades of this simpler geometry have required careful resharpening of the cutting face (or chip face) each time the cutting tool is resharpened for further usage in a cutter head assembly of a gear cutting machine. This requirement not only adds to the cost of use of a particular cutting tool, but also prevents the usage of certain metallurgical treatments (such as hard coatings) of the cutting face portions of such tools because such treatments would be destroyed during the resharpening process if it were necessary to remove portions of the cutting face with each resharpening.

The invention of U.S. Pat. No. 3,881,889, offered a completely different approach to the problem of reducing cost and complexity of cutting blades for gear cutting machinery. In accordance with that invention, cutting blades can be manufactured and resharpened in such a manner that all critical relationships required for gear cutting applications are maintained, while a front face surface of each cutting blade is preserved during each resharpening of the cutting blade. This not only eliminates the cost and difficulty of resharpening the critical front face parameter for each cutting blade tool but also permits the use of unusual material combinations (such as titanium, carbide, chromium or vanadium coatings with high speed steel substrates) or other treatments of the blades, to thereby produce cutting tools having longer life and greater strength. In addition, treated cutting tools can produce better surface finish on a completed gear.

The present invention follows the same basic method of resharpening that is described in U.S. Pat. No. 3,881,889 and offers for that method additional steps of control of the sharpening process for achieving greater control of dimensional and geometric relationships for batch sharpening of such cutting blades, and greater productivity (and therefore lower cost) of manufacturing such cutting blades with specialized grinding equipment.

In accordance with the present invention, all critical surfaces of a cutting blade are formed and established in what amounts to a single grinding plane of a grinding wheel. This single grinding plane may be considered a flat plane for many typical grinding operations contemplated herein, but it is also intended that the terminology "single grinding plane" include grinding wheel surfaces which have been shaped to produce special profiles on cutting blades. In contrast to what will be described herein as a "single grinding plane", the grinding equipment illustrated by way of example in U.S. Pat. No. 3,881,889 required the use of separate grinding planes 66 and 68 (FIGS. 7–11 thereof) of a grinding wheel in order to carry out all steps of resharpening of a cutting blade having a preserved front face portion. Grinding wheels which are designed and manufactured with multiple grinding planes are far more costly to purchase and difficult to maintain than grinding wheels of simpler design which include a single grinding plane for carrying out all grinding operations. Thus, the basic approach of the present invention is a significant one inasmuch as it permits the use of simpler and less costly grinding wheels for establishing critical relationships on cutting blades having preserved front faces.

In order to carry out a precision grinding operation on all needed surfaces of cutting blades in a single grinding plane, it is important that certain relationships be established between the individual cutting blades to be sharpened and the single grinding plane of the grinding wheel. In addition, it is important in grinding operations of this type, which involve a series of steps of separate grinding contacts with a grinding surface (as is required for producing separate profile surfaces on gear cutting blades), to precisely locate each surface being ground with other surfaces which were previously ground or which will be subsequently ground. Maintenance of correct relationships, and even knowing precisely where a workpiece is located at all times relative to a grinding surface, become more difficult as more and more workpieces are introduced into each grinding cycle. Thus, the problems of correctly relating a single cutting blade to a grinding surface become greatly increased when a plurality of cutting blades are being handled at the same time. The present invention has an objective of solving these problems.

In its broadest form, the method of the present invention provides for establishing accurate positionings of a cutting blade relative to a grinding wheel during a sequence of grinding operations which includes the sharpening of (a) a topland of surface, (b) a first side relief surface, and (c) a second side relief surface on the cutting blade, and this is accomplished with a series of steps comprising a first step of establishing a reference axis relative to the cutting blade and to a grinding plane of the grinding wheel, a second step of relatively advancing the cutting blade and the grinding wheel in a reference plane which is parallel to a reference side of the cutting blade and which passes through the reference axis during engagement of the topland portion of the cutting blade with the grinding wheel to thereby form a topland surface on the cutting blade, a next step of swinging the cutting blade about the reference axis for relatively advancing the first side portion of the cutting blade and the grinding wheel to thereby form a first side relief surface on the cutting blade during engagement of the first side portion of the cutting blade with the grinding wheel, a further step of turning the cutting blade over so as to bring a second side portion of the cutting blade into the reference plane, and finally, a step of relatively advancing the second side portion of the cutting blade and the grinding wheel to thereby form a second side relief surface on the cutting blade.

Stated more specifically, the method of this invention provides for a series of steps for grinding critical surfaces on a batch of cutting blades of the type that require no sharpening of their front cutting faces but which do require sharpening of topland and side relief surfaces. This method comprises, but is not limited to, the steps of mounting a batch or plurality of cutting blades in a holder which functions to spin the plurality of blades into a single grinding plane of a grinding wheel so that corresponding profile surfaces can be ground on all of the cutting blades as they spin in contact with the grinding wheel during a single set-up of the cutting blades in the holder, the spinning of the holder and its contained cutting blades being in a plane of rotation that intersects a reference axis, and forming the topland surface and the first side relief surface of each cutting blade while the holder is spinning in separate positions of orientation relative to the grinding wheel, after which the holder is turned over in a turning axis which is slightly offset from the reference axis, following which there is a step of forming the second side relief surface while the holder is spinning relative to the grinding wheel.

These and other features and details of the invention will become apparent in the more detailed discussion which follows, and in that discussion reference will be made to the accompanying drawings, as briefly described below.

DETAILED DESCRIPTION OF INVENTION

Figure 1:
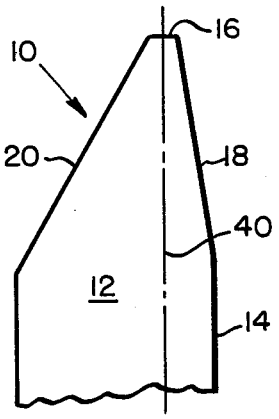
FIG. 1 is a plane view of the cutting end portion of a cutting blade which can be sharpened in accordance with the present invention.

The cutting end portion of a single cutting blade 10 is illustrated in FIG. 1 for purposes of describing critical surfaces which must be sharpened on cutting blades of this type. The illustrated blade is typically longer than shown, and includes a front face portion 12 which does not require sharpening. Thus, the front face portion 12 can be chemically or metallurgically treated to improve cutting characteristics of the cutting blade. The illustrated cutting blade is formed from suitable bar stock material, such as high speed steel, and may have a cross sectional shape and other basic configurations of the type shown in copending application Ser. No. 741,837, (now U.S. Pat. No. 4,060,881) as identified above. A reference side 14 is provided on each cutting blade to establish a mounting surface that can be used during sharpening of the blade and for mounting a number of such blades in a cutter body for performing work. Cutting blades of this type can be mounted as shown in the aforesaid pending application for use in specialized gear cutting machinery which produces bevel and hypoid gear products. In addition, blades of a similar type can be used for cutting spur and helical gears.

Surfaces of the cutting blade 10 that do require sharpening include (a) a topland surface 16, (b) a first side relief surface 18, and (c) a second side relief surface 20. The back side of the cutting blade (not visible in the FIG. 1 representation) does not require sharpening. The critical surfaces to be sharpened are illustrated in greatly enlarged form in FIG. 2 wherein it can be seen that the topland surface 16 constitutes a measurable blade tip width 22 that may be blended at its extremities with the first side relief surface 18 and the second side relief surface 20, as shown. The theoretical tip width 22 of the cutting blade constitutes a critical dimension for cutting blades of this type and requires therefore a precise relationship with each of the side relief surfaces 18 and 20. Establishment of the relationships will be discussed in greater detail later with reference to the FIGS. 11 through 15 views.

Considering the possibility of sharpening only a single blade at a time in accordance with the present invention, FIGS. 3 through 10 illustrate sequential steps and relationships that must be established to carry out a sharpening of all topland and side relief surfaces of a single cutting blade. In these views, a grinding plane 30 is established by a moving grinding surface such as that provided by a grinding wheel 32 rotating in the direction shown in FIG. 4.

As a first step in carrying out the basic method, it is necessary to establish a reference axis 34 which serves to correctly relate the position of the cutting blade 10 to a grinding plane 30 during all sharpening operations on the various surfaces of the cutting blade. A reference plane 36 is also established, and this reference plane may be considered a plane which is parallel to the reference side 14 of the cutting blade and which passes through the reference axis 34. Thus, the reference plane is at least parallel with the central longitudinal axis of the cutting blade and may be coincident with that axis in certain blade configurations.

Having established a reference axis 34 and reference plane 36, the cutting blade 10 and the grinding wheel 34 are relatively advanced in the reference plane to bring the tip end of the cutting blade into engagement with the grinding wheel. Relative advancement is continued for a sufficient distance to form a topland surface 16 at the tip end of the cutting blade 10. The final relative positions of the cutting blade 10 and the grinding wheel 32 are illustrated in the FIG. 5 view.

Figure 5:
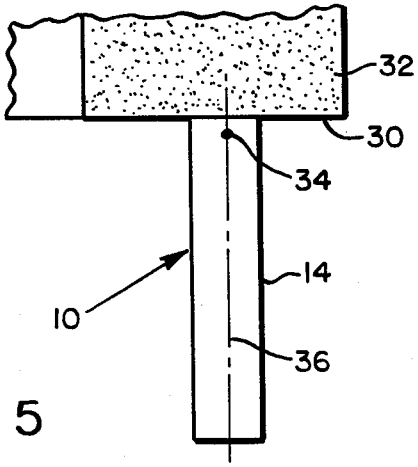
FIG. 5 is a representation similar to that shown in FIG. 3, showing an initial step of sharpening in which a topland surface is formed on a single cutting blade.
Figure 6:
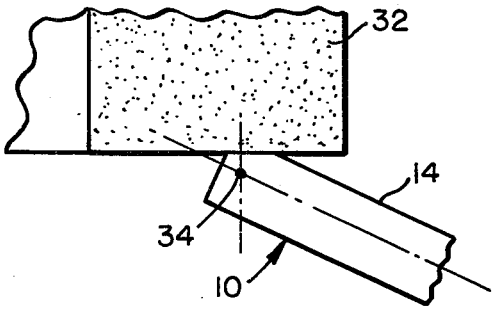
FIG. 6 continues the representations shown in FIGS. 3-5, showing basic relationships for forming a first side relief surface on a cutting blade.
Figure 7:
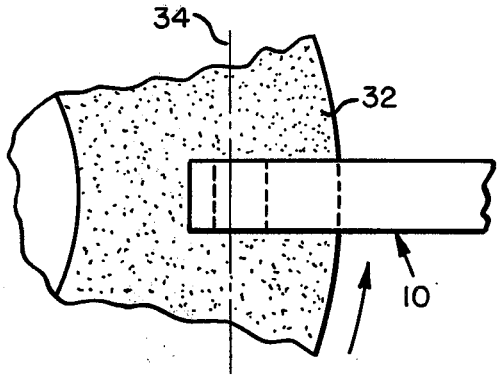
FIG. 7 is a view similar to FIG. 4, showing the relationship of FIG. 6 as seen when looking toward the grinding surface.

FIGS. 6 and 7 illustrate the next step of the method in which the cutting blade 10 is swung about the reference axis 34 from the position shown in FIG. 5 to the one shown in FIG. 6. This motion results in the formation of a first side relief surface 18 on the cutting blade, and, in addition, the topland surface 16 and first side relief surface 18 are blended by a curved surface 38 (FIG. 2), as determined by the swinging motion of the cutting blade 10 about the reference axis 34.

Figure 8:
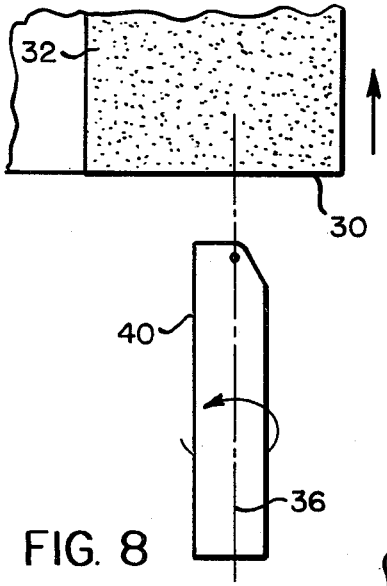
FIG. 8 represents a further step of the basic method in which a cutting blade is turned over while out of contact with the grinding surface.
Figure 9:
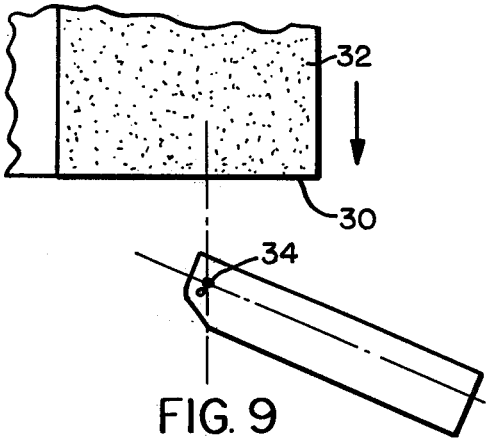
FIG. 9 illustrates the cutting blade in its new position and relative advancement of the cutting blade and the grinding surface.
Figure 10:
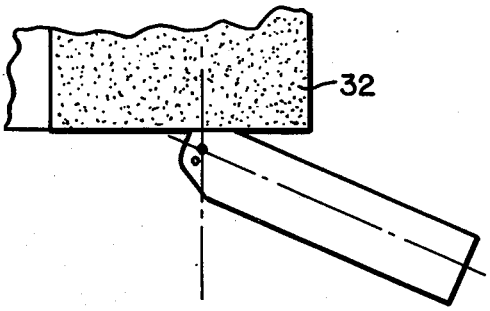
FIG. 10 illustrates basic relationships for forming a second side relief surface on a single cutting blade.

After the topland and first side relief surfaces are formed, the cutting blade 10 and grinding wheel are relatively withdrawn so that the cutting blade can be turned over. In order to do this in a way that maintains known relationships between the surfaces being formed, the cutting blade 10 may be first swung back to a position in which the reference plane 36 is perpendicular to the grinding plane 30, as shown in FIG. 8. Then, the cutting blade 10 is turned over in an axis included in a plane bisecting the predetermined positions for the reference axis placement relative to the end portion of the cutting blade. This brings a second side of the cutting blade into the reference plane so that the cutting blade can be swung around the reference axis 34 and relatively advanced with the grinding wheel 32 to form a second side relief surface 20 as shown in FIGS. 9 and 10. Alternatively, the cutting blade 10 may be turned over while in the positions shown in FIG. 6 (after being withdrawn from contact with the grinding wheel).

Figure 2:
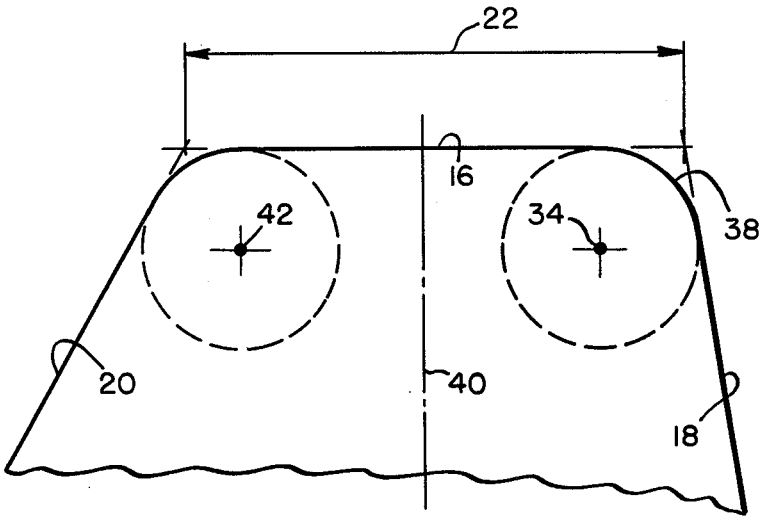
FIG. 2 is a greatly enlarged view of the very tip portion of the cutting blade shown in FIG. 1.
Figure 3:
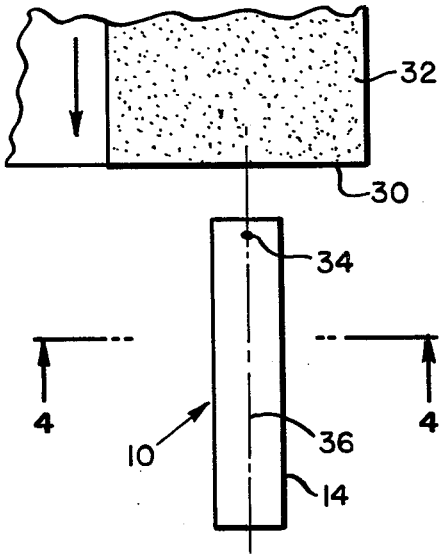
FIG. 3 is a schematic representation of basic relationships between a single cutting blade and a grinding surface in accordance with the basic method of the present invention.
Figure 4:
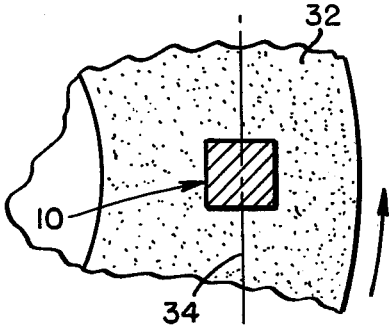
FIG. 4 is a view of the relationship shown in FIG. 3, as seen from line 4—4 of FIG. 3.

The step of turning the cutting blade over relative to the reference axis 34 can be better appreciated from the greatly enlarged representations in FIG. 2. In that view, the position of reference axis 34 is shown as it would appear when the topland surface 16 and first side relief surface 18 are being sharpened. When it is desired to turn the cutting blade over to bring the second side relief surface 20 to correct placement for sharpening, the cutting blade is turned over in an axis lying within a plane 40 which bisects the linear distance between the point where axis 34 is shown and a point 42 which will be brought into coincidence with the position of axis 34. Thus, as the cutting blade is turned over, the point 42 is established as the point through which axis 34 passes, and is thereby brought into the reference plane 36.

The above discussion is intended to describe the basic method of this invention as practiced with a single cutting blade. However, one of the practical advantages of this method is that it lends itself to batch processing of a plurality of cutting blades with machinery designed for high production precision grinding. A detailed description of machinery of this type is included in the companion application (identified at the beginning of this specification), and therefore, the present discussion will not attempt to describe full details of an apparatus which is, in itself, a separate invention. However, a type of apparatus for batch processing will be discussed below, with reference to FIGS. 11–15, so that persons skilled in this art, may appreciate the batch processing potential for the method described and claimed here.

Figure 11:
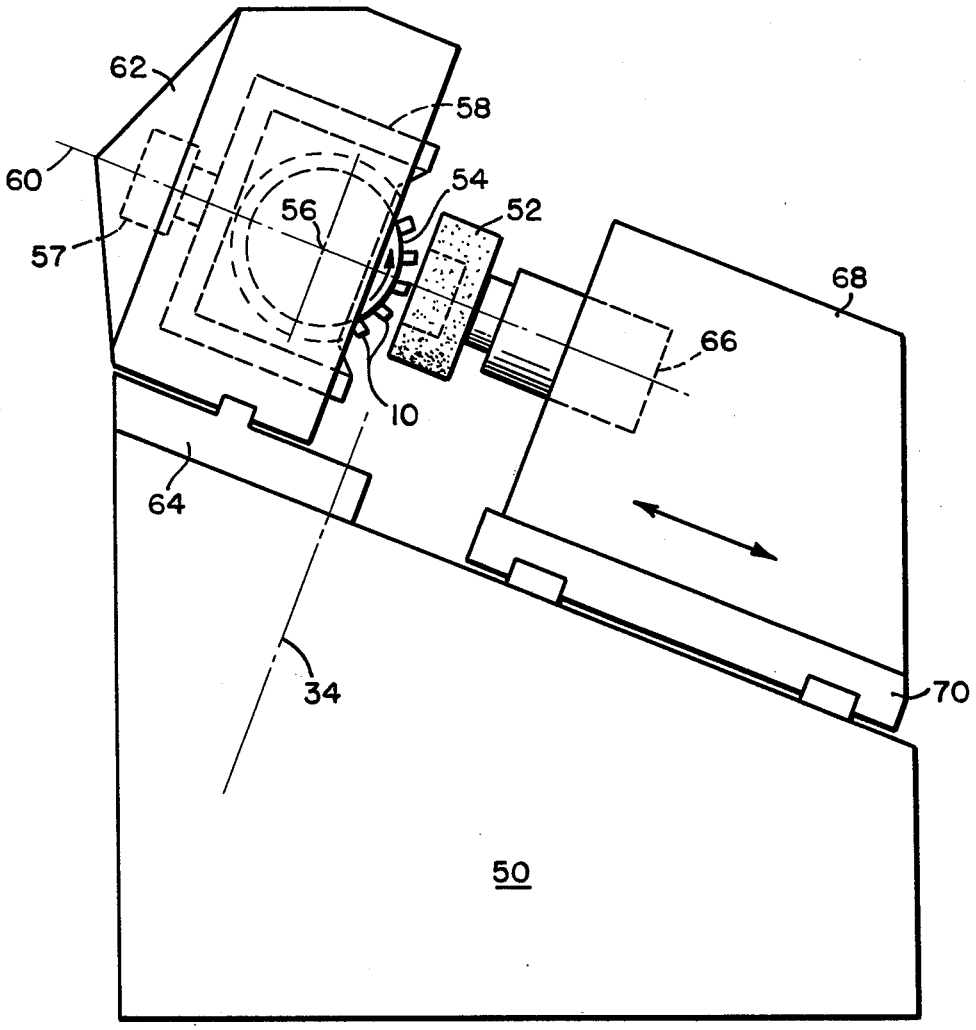
FIG. 11 is a highly schematic depiction of basic apparatus which may be used for carrying out the method of the present invention.

Referring to FIG. 11, a basic apparatus for sharpening a plurality of cutting blades in accordance with the method of this invention includes a machine having a base 50, a cup-shaped grinding wheel 52, and a ring-shaped holder 54 for carrying a plurality of cutting blades 10. The ring-shaped holder 54 is mounted to rotate about an axis 56, and a drive means 57 provides for a relatively rapid (20–30 rpm) rotation of the holder 54 and its contained cutting blades. The holder 54 is contained within a cradle assembly 58 which is mounted in bearings for being rotated about the axis 60 (which lies within the plane 40 discussed with reference to FIG. 2). In addition, the entire cradle assembly 58, its contained holder 54, and supporting structures 62 can be pivoted about the axis 34 through a controlled swinging movement of a base plate 64.

At the other end of the apparatus, the grinding wheel 52 is mounted for rotation and is provided with a drive motor 66. The grinding wheel 52 and drive motor 66 are carried within a housing 68 mounted for movement toward and away from the cutting blades. In addition, a base plate 70 can be traversed relative to the base 50 of the machine so as to carry the grinding wheel 52 out of alignment with the cutting blades and into a position where its grinding surface can be dressed by suitable dressing devices.

Figure 12:
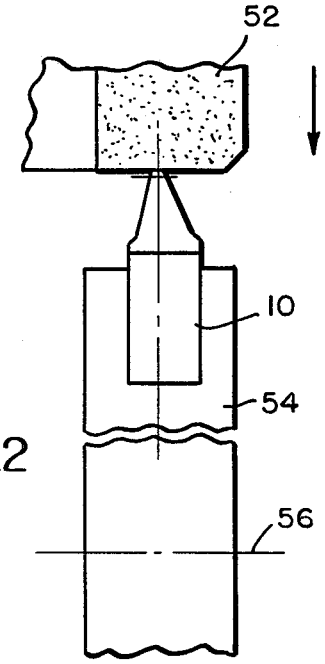
FIG. 12 is a topland view of basic relationships between the holder and a grinding wheel of the apparatus of FIG. 11 during formation of topland surfaces on a plurality of blades carrried by the holder.

FIGS. 12–15 illustrate sequential steps of sharpening which can be carried out on the apparatus shown in FIG. 11 in the same manner as was discussed above with reference to the sharpening of a single blade. FIG. 12 illustrates relative positioning of the holder 54 for spinning about its axis 56 so as to bring each of its contained cutting blades 10 into grinding engagement with the grinding wheel 52. This relative positioning forms a topland surface for all of the cutting blades as they are spun past the grinding wheel, and this operation corresponds to the step illustrated in FIG. 5 above.

Figure 13:
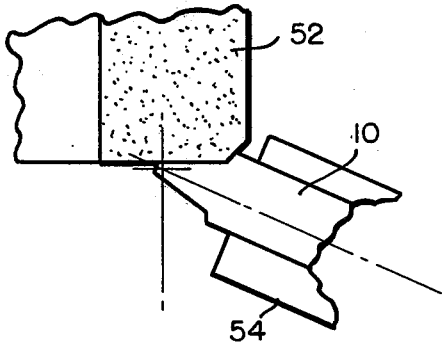
FIG. 13 illustrates basic relationships for forming first side relief surfaces on a plurality of blades carried by the holder as the holder spins relative to the grinding wheel.
Figure 14:
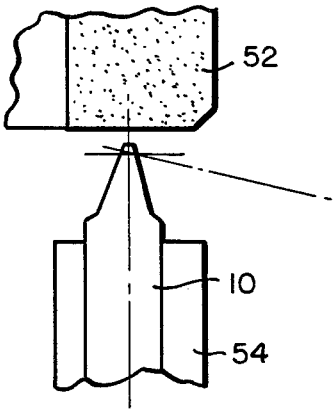
FIG. 14 illustrates a disengagement of the grinding wheel and holder so that the entire holder can be turned over.
Figure 15:
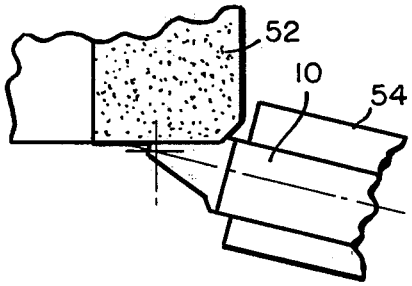
FIG. 15 illustrates a final step of forming second side relief surfaces on all blades when the holder is in its turnover attitude.

After the topland surface is formed, the holder 54 and all of its contained blades 10 are swung about the axis 34 to the positions shown in FIG. 13 for forming a first side relief surface in the same manner as discussed with reference to FIGS. 6 and 7 above. Next, the holder is returned to its original position and the grinding wheel is withdrawn so that the entire cradle assembly 58 and the holder 54 can be turned over in the axis 40 as discussed above with reference to FIG. 8. The final step shown in FIG. 15 is one of swinging the holder about the axis 34 again and bringing the grinding wheel into grinding engagement with the cutting blades carried in the holder to produce second side relief surfaces on all of the cutting blades.

Alternatively, the holder 54 can be indexed to successive positions for grinding all surfaces on a single blade at a time before proceeding with a next adjacent blade if special relief surfaces are required. It should be apparent though that processing is much more rapid with the first-described method of spinning the holder and all contained blades past the grinding wheel to form given surfaces for all blades at the same time.

Of course, the method involves additional steps of relative withdrawing of the workpiece and grinding surface as needed for periodic dressing of the grinding wheel surface to maintain a preferred shape on the grinding wheel. The rotational relationships between the spinning holder and the grinding wheel are such that material is removed in a direction away from the protected front face of each cutting blade as it is being sharpened. This prevents an unwanted build up of material or roughness along the important cutting edge of the individual cutting blades. Thus, after a topland and first side relief surface have been formed, the direction of rotation of the grinding wheel should be reversed to accomodate this requirement after the blades have been turned over.

Although the invention has been described with reference to only one type of batch processing it should be apparent that a plurality of cutting blades can be arranged in a linear path as well as the circular path described herein. Also, other forms and shapes of grinding wheels or other abrading or stock removal means may be utilized, and relative advancement and withdrawal of the cutting blades and the grinding wheels can be achieved by moving the positions of cutting blades as well as moving the position of the grinding wheel. Other variations and modifications will be apparent to persons skilled within this art, and those variations and modifications which are fully equivalent to what has been described herein are intended to be included within the scope of the claimed invention.

What is claimed is:

1. A method of grinding which includes steps of establishing precise positioning of a plurality of cutting tools relative to a grinding plane of a grinding wheel to thereby sharpen (a) a topland surface, (b) a first side relief surface, and (c) a second side relief surface on said plurality of cutting tools, comprising mounting said cutting blades in a serial arrangement in a circular holder which allows selected corresponding surfaces of the cutting blades to be sharpened as the cutting blades and grinding wheel are relatively advanced, said mounting arrangement being such that all of the cutting blades are carried in positions which are correspondingly the same relative to a reference plane that is common to all cutting blades, spinning said holder relative to said grinding wheel, said spinning taking place in a reference plane which is parallel to reference sides of said cutting blades, said reference plane being positioned to intersect a reference axis about which each blade is swung during a grinding operation, said positioning being such that the reference axis is located at a set radial distance from one corner of the topland surface and an adjacent side relief surface of a cutting blade in a grinding position relative to the grinding plane of the grinding wheel, relatively advancing the cutting blades and the grinding wheel to form a topland surface and a first side relief surface on each of the cutting blades, turning over all of the cutting blades, and relatively advancing the cutting blades and the grinding wheel to form a second side relief surface on each of the cutting blades.

2. The method of claim 1 wherein said step of turning over the cutting blades comprises a step of turning over said holder.

3. The method of claim 1 wherein the step of forming said topland surface and said first side relief surface includes separate grinding operations comprising relatively advancing said holder and said grinding wheel in the plane of rotation of the grinding wheel so that end portions of the cutting blades are brought into the grinding plane of the grinding wheel to form said topland surfaces on the cutting blades, swinging said holder about said reference axis, and relatively advancing the holder and the grinding wheel to form said first side relief surface.

4. The method of claim 1 and including a step of reversing the direction of grinding action between said cutting blades and said grinding wheel when said holder is turned over in its turning axis (for forming the second side relief surface) to thereby provide for a grinding action that tends to move material away from the front face of each cutting blade as each surface is sharpened thereon.

* * * * *